US008404974B1

(12) United States Patent
O'Connor

(10) Patent No.: US 8,404,974 B1
(45) Date of Patent: Mar. 26, 2013

(54) STUFFER CAP FOR PATCH PANEL OF RACK SYSTEM

(75) Inventor: Douglas Paul O'Connor, Richmond, RI (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 13/298,675

(22) Filed: Nov. 17, 2011

(51) Int. Cl.
*H01R 13/631* (2006.01)

(52) U.S. Cl. ..... 174/100; 174/99 R; 211/26; 312/265.4

(58) Field of Classification Search ..... 174/100, 174/99 R; 211/26; 312/265.4
See application file for complete search history.

(56) References Cited

U.S. PATENT DOCUMENTS

| | | | | |
|---|---|---|---|---|
| 4,188,083 | A | | 2/1980 | Knowles |
| 4,859,201 | A | * | 8/1989 | Marsh ..... 439/290 |
| 5,044,979 | A | | 9/1991 | Siemon |
| 5,108,306 | A | | 4/1992 | Wellinsky |
| 5,114,362 | A | | 5/1992 | Olsson |
| 5,125,850 | A | | 6/1992 | Locati |
| 5,409,396 | A | | 4/1995 | Bowen |
| 5,540,600 | A | * | 7/1996 | Ivey ..... 439/417 |
| 5,626,490 | A | * | 5/1997 | Pitts et al. ..... 439/404 |
| 5,647,763 | A | * | 7/1997 | Arnold et al. ..... 439/540.1 |
| 5,766,033 | A | | 6/1998 | Davis |
| 6,338,643 | B1 | | 1/2002 | Miller |
| 6,347,715 | B1 | | 2/2002 | Drozdenko |
| 7,619,164 | B2 | | 11/2009 | Caveney |
| 7,745,738 | B2 | | 6/2010 | Nakayama |
| 7,794,286 | B2 | | 9/2010 | AbuGhazaleh |
| 7,946,894 | B2 | | 5/2011 | AbuGhazaleh |

* cited by examiner

*Primary Examiner* — Gary F. Paumen
(74) *Attorney, Agent, or Firm* — Marcus R. Mickney; Mark S. Bicks; Alfred N. Goodman

(57) ABSTRACT

A stuffer cap includes a body member and a plurality of strain relief members extending outwardly from the body member to engage wires terminated at a patch panel of a rack system. A plurality of first latching members extend outwardly from the body member to engage the patch panel. A plurality of second latching members extend outwardly from the body member to engage the patch panel. The plurality of second latching members are oriented differently from the plurality of first latching members.

20 Claims, 15 Drawing Sheets

STUFFER CAP FOR PATCH PANEL OF RACK SYSTEM

FIELD OF THE INVENTION

The present invention relates to a stuffer cap for providing strain relief to terminated wires. More particularly, the present invention relates to a stuffer cap removably connectable to a patch panel adapter assembly to provide strain relief to cables terminated at the patch panel adapter assembly. Still more particularly, the present invention relates to a patch panel adapter assembly including a stuffer cap to provide strain relief to terminated cables and being connectable to a patch panel of a rack system.

BACKGROUND OF THE INVENTION

Data technology is being used to an increasing extent in the communications industry to carry various types of signals and data. In telephone communications, for example, the use of data lines between central offices and individual residential and business subscribers has allowed for large increases in signal traffic and improved signal quality. Telecommunications circuitry is generally housed in telecommunications cabinets placed at or near the subscriber locations, with a single cabinet typically serving a large number of individual subscribers. In telecommunications cabinets, racks or banks of circuits are provided in the form of slide-out circuit boards that are easily removed from the equipment rack when repair or replacement is needed. Due to the large number of circuit boards housed in a telecommunications cabinet, an even greater number of cables, including, but not limited to, fiber optic and copper cables, are also housed in the telecommunications cabinet. The numerous cables tend to interfere with access to the various components and circuit boards housed in the telecommunications cabinet.

One problem associated with the large number of cables terminated at a rack system is that the cables typically hang downwardly from their terminated position. The weight of the hanging cables can cause a terminated cable to become pulled out of its terminated position, thereby resulting in an electrically open condition. Accordingly, a need exists for maintaining a cable in its terminated position to substantially prevent an electrically open condition.

Because data cables can be fragile and cannot be bent or deformed in the same manner as electrical power wires, it is difficult to compactly and efficiently manage the data cables. The data cables can interfere with work done by personnel in the telecommunications cabinet such that the personnel often must move the data cables out of the way in the area in which they are working, thereby subjecting the cable to undesirable bending or flexing. Furthermore, due to the large number of cables within the telecommunications cabinet, personnel often accidentally bump into or move the cables. Due to the fragility of the cables, small degrees of bending or flexing may damage or even break the cables. Accordingly, a need exists to provide strain relief to cables terminated at a rack system to substantially prevent a cable from becoming pulled out of its terminated position.

SUMMARY OF THE INVENTION

Accordingly, it is a primary objective of the present invention to provide a stuffer cap to provide strain relief to cables terminated at a patch panel of a rack assembly.

A further objective of the present invention is to provide a stuffer cap removably connectable to a patch panel adapter assembly to provide strain relief to terminated cables.

Another objective of the present invention is to provide a patch panel adapter assembly connectable to a patch panel of a rack system and a stuffer cap removably connectable to the patch panel adapter assembly to provide strain relief to cables terminated thereto.

The foregoing objectives are basically attained by a stuffer cap that includes a body member and a plurality of strain relief members extending outwardly from the body member to engage wires terminated at a patch panel of a rack system. A plurality of first latching members extend outwardly from the body member to engage the patch panel. A plurality of second latching members extend outwardly from the body member to engage the patch panel. The plurality of second latching members are oriented differently from the plurality of first latching members.

The foregoing objectives are also basically attained by a patch panel adapter assembly for terminating wires at a rack system. A first housing has a plurality of insulation displacement contacts to terminate wires. A second housing has a plurality of openings to receive electrical connectors. A printed circuit board assembly is secured between the first and second housings. A stuffer cap is removably connected to the first housing. A plurality of strain relief members extend outwardly from a body member of the stuffer cap to engage wires terminated by the plurality of insulation displacement contacts. A plurality of first latching members extend outwardly from the body member to engage the first housing. A plurality of second latching members extend outwardly from the body member to engage the first housing. The plurality of second latching members are oriented differently from the plurality of first latching members.

Other objects, advantages and salient features of the invention will become apparent from the following detailed description, which, taken in conjunction with the annexed drawings, discloses an exemplary embodiment of the invention.

As used in this application, the terms "front," "rear," "upper," "lower," "upwardly," "downwardly," and other orientational descriptors are intended to facilitate the description of the exemplary embodiments of the present invention, and are not intended to limit the structure thereof to any particular position or orientation.

BRIEF DESCRIPTION OF THE DRAWINGS

The above aspects and features of the present invention will be more apparent from the description for an exemplary embodiment of the present invention taken with reference to the accompanying drawings, in which.

Throughout the drawings, like reference numerals will be understood to refer to like parts, components and structures.

DETAILED DESCRIPTION OF AN EXEMPLARY EMBODIMENT

Figure 1:
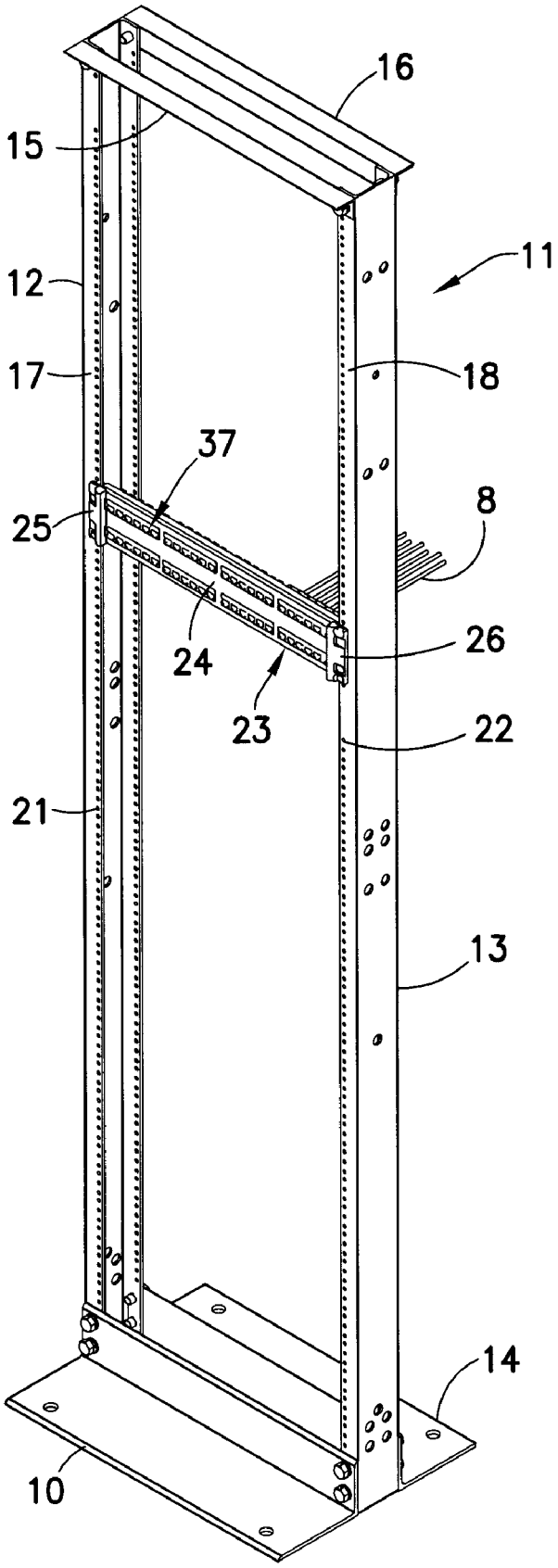
FIG. 1 is a front perspective view of a rack system with which a stuffer cap in accordance with an exemplary embodiment of the present invention is usable.
Figure 2:
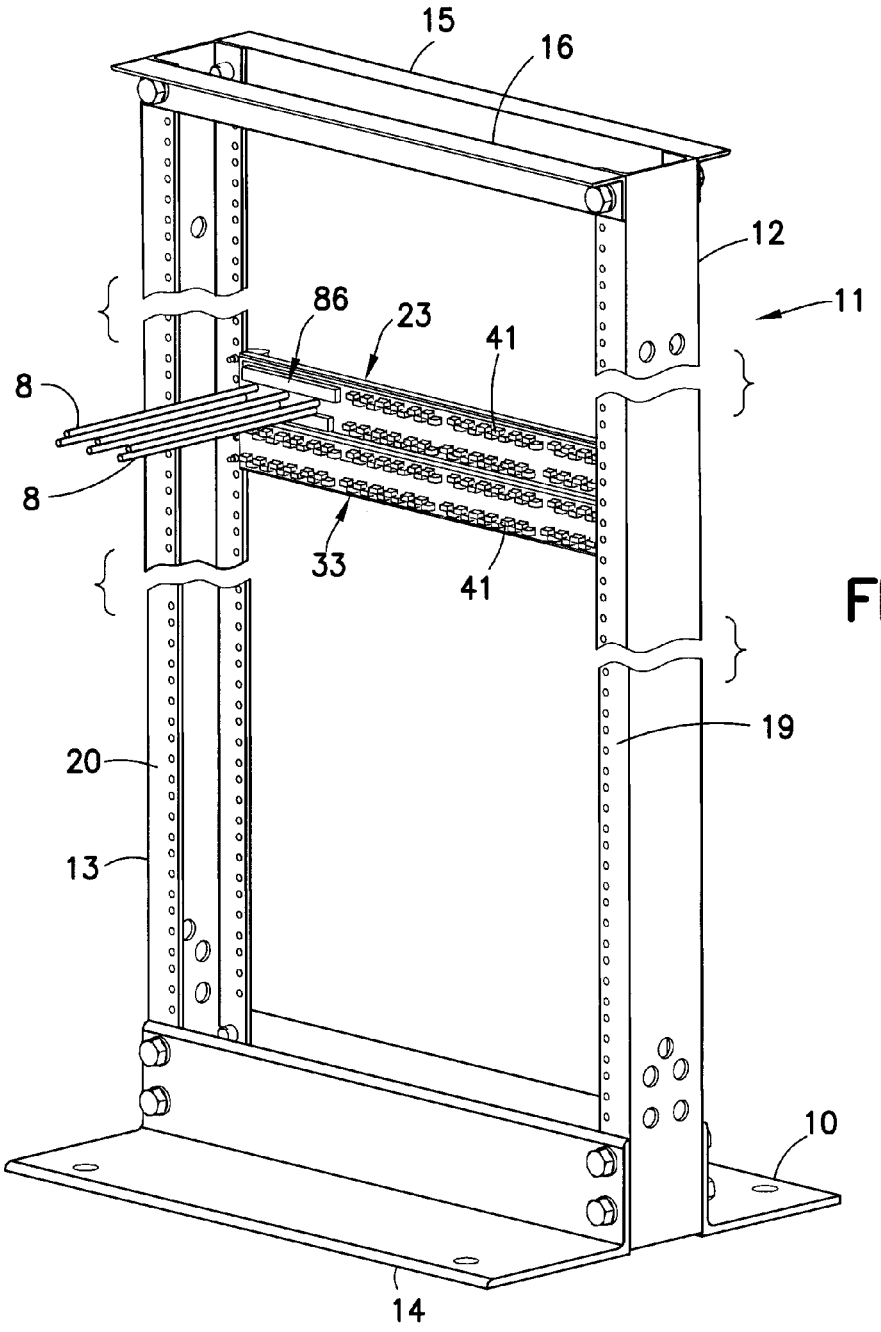
FIG. 2 is a rear perspective view of the rack system of FIG. 1 in which a stuffer cap in accordance with an exemplary embodiment of the present invention provides strain relief to terminated cables.
Figure 4:
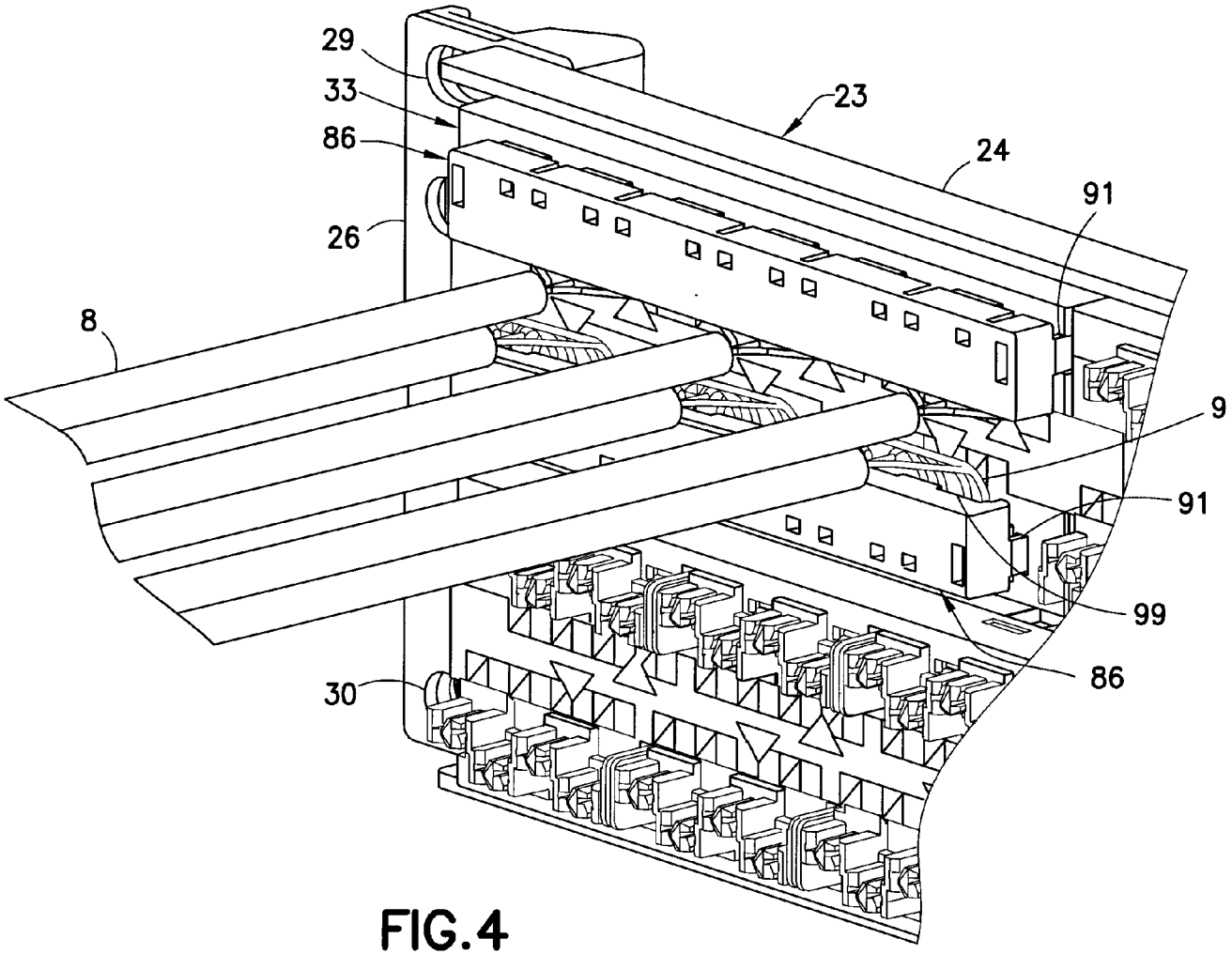
FIG. 4 is an enlarged rear perspective view of the rack system of FIG. 3 in which the stuffer cap is connected to the patch panel adapter assembly.
Figure 5:
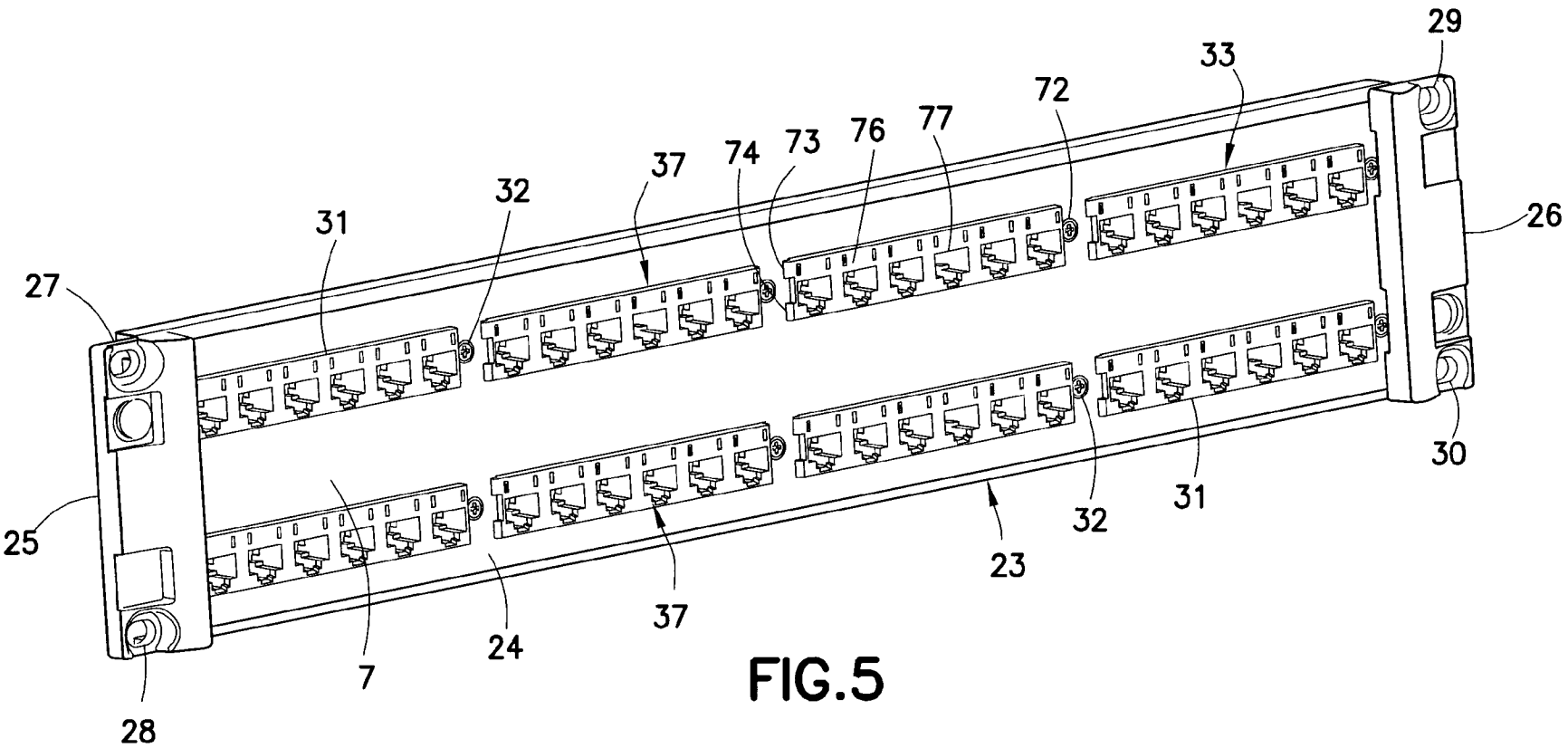
FIG. 5 is a perspective view of a patch panel assembly in accordance with an exemplary embodiment of the present invention.

As shown in FIGS. 1-17, a stuffer cap 86 removably connectable to a patch panel adapter assembly 33 provides strain relief to cables terminated thereto. The patch panel adapter assembly 33 is connectable to a patch panel 23, as shown in FIG. 5. The patch panel 23 is connectable to a rack system 11, as shown in FIGS. 1 and 2. Wires 9 of cables 8 are terminated to the patch panel adapter assembly 33 on a rear side of the rack system 11, and electrical connectors, such as JR-45 jacks, are connectable to connector openings 77 of the patch panel adapter assembly 33 accessible from a front side of the rack system 11.

The rack system 11, as shown in FIGS. 1 and 2, includes first and second channel members 12 and 13. The first and second channel members 12 and 13 are secured to first and second base members 10 and 14 of the rack system 11 at lower ends of the channel members. The first base member 10 is connected to front surfaces 17 and 18 of the first and second channel members 12 and 13. The second base member is connected to rear surfaces 19 and 20 of the first and second channel members 12 and 13. Preferably, the first and second base members are substantially L-shaped. A first bracket 15 connects the front surfaces 17 and 18 of the first and second channel members 12 and 13 at upper ends thereof. A second bracket 16 connects the rear surfaces 19 and 20 of the first and second channel members 12 and 13 at upper ends thereof. The first and second brackets 15 and 16 are preferably substantially L-shaped. A plurality of fastener holes 21 and 22 extend along the front surfaces 17 and 18 of the first and second channel members 12 and 13.

A plurality of patch panels 23 are connected to the rack system, as shown in FIGS. 1 and 2. The patch panel 23 includes a panel member 24 having first and second ends 25 and 26, as shown in FIG. 5. First and second fastener openings 27 and 28 receive fasteners to secure the first end 25 of the patch panel 23 to openings 21 in the front surface 17 of the first channel member 12. First and second fastener openings 29 and 30 receive fasteners to secure the second end 26 of the patch panel to openings 22 in the front surface 18 of the second channel member 13. A plurality of openings 31 are formed in the panel member 24. A fastener opening 32 is disposed adjacent an end of each panel member opening 31. Preferably, as shown in FIG. 5, eight openings 31 are formed in the panel member 24.

Figure 6:
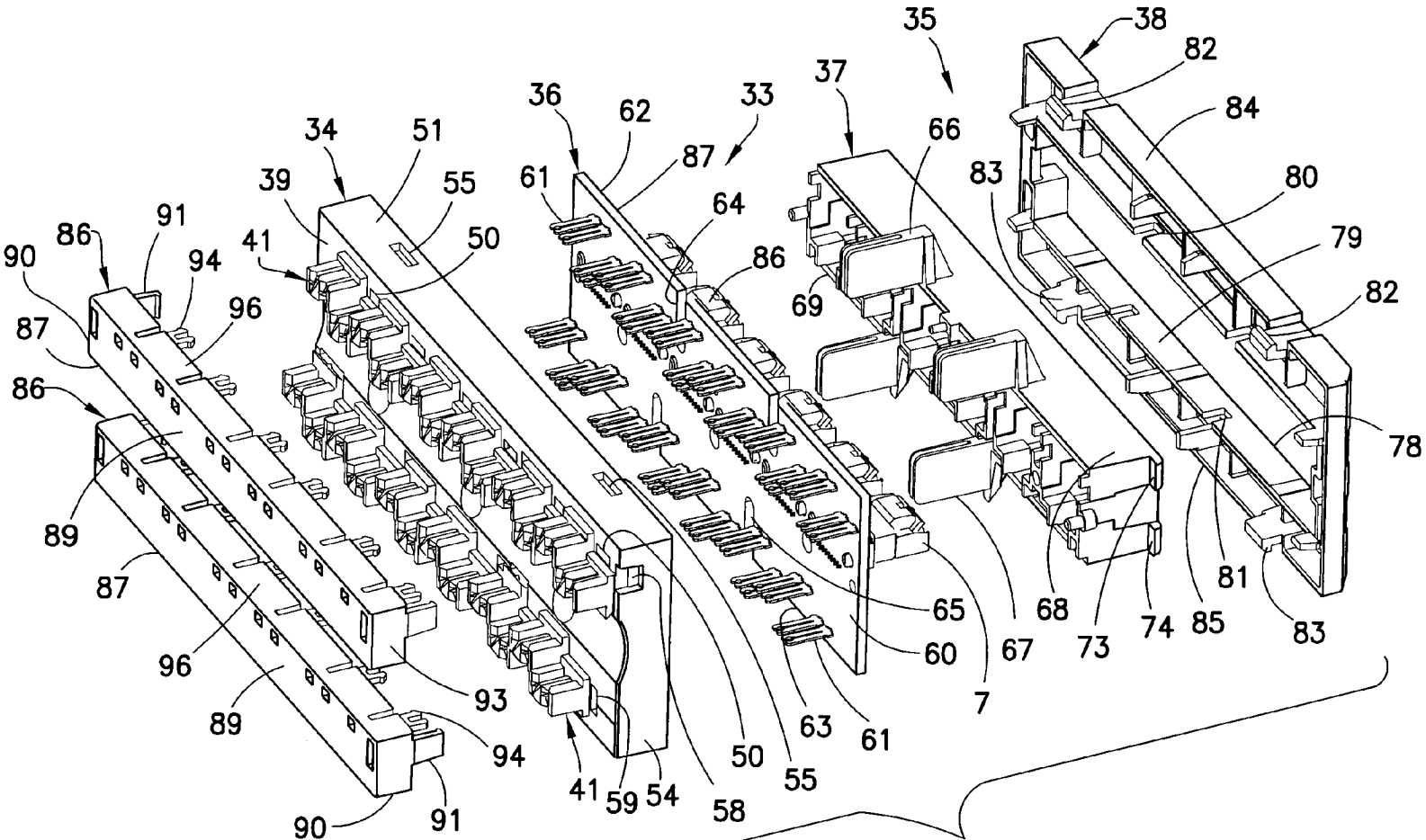
FIG. 6 is an exploded perspective view of a patch panel adapter assembly in accordance with an exemplary embodiment of the present invention.

A patch panel adapter assembly 33, as shown in FIG. 6, includes a first housing 34, a second housing 35 and a printed circuit board (PCB) assembly 36 disposed therebetween. The second housing 35 includes an inner part 37 and an outer part 38.

Figure 7:
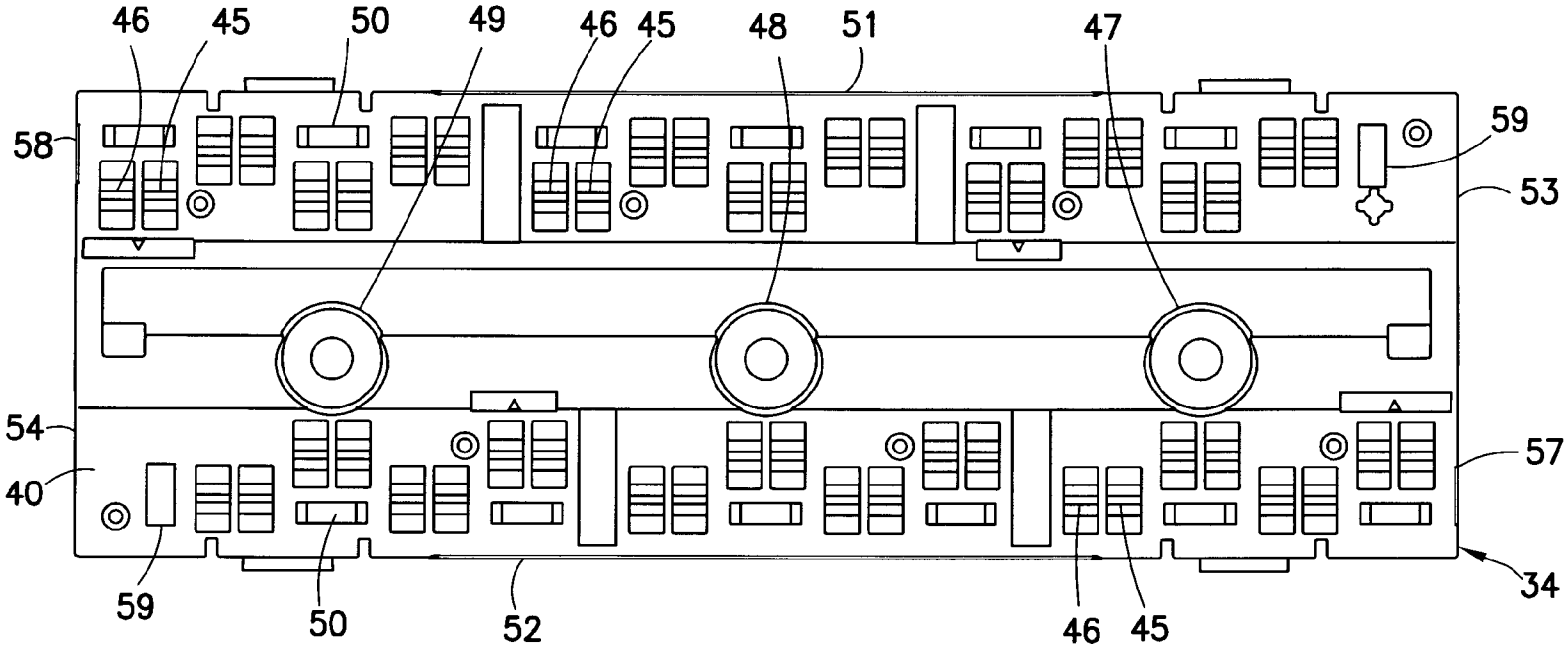
FIG. 7 is a front elevational view of a first housing of the patch panel adapter assembly of FIG. 6.
Figure 8:
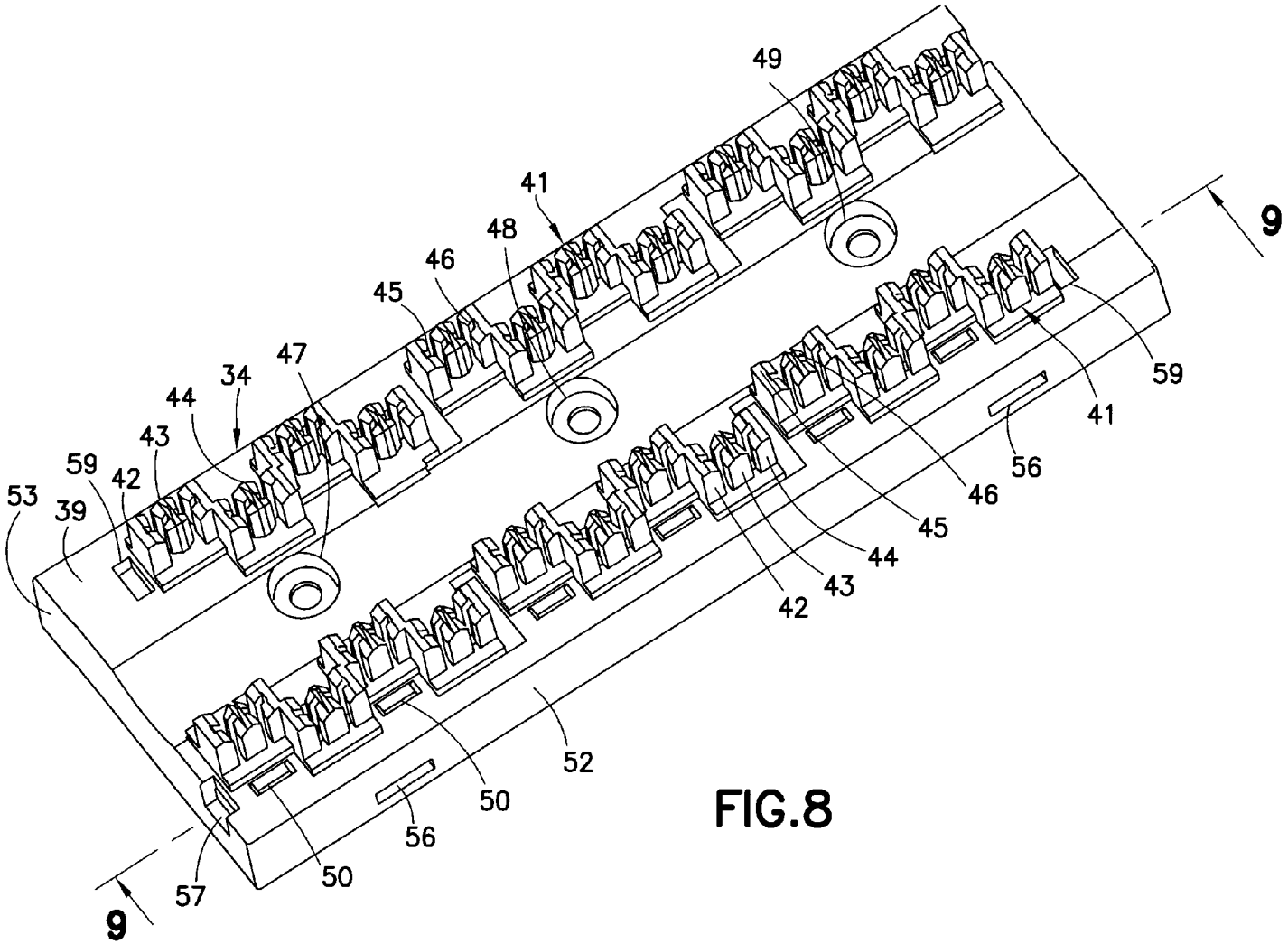
FIG. 8 is a perspective of the first housing of FIG. 7.
Figure 9:
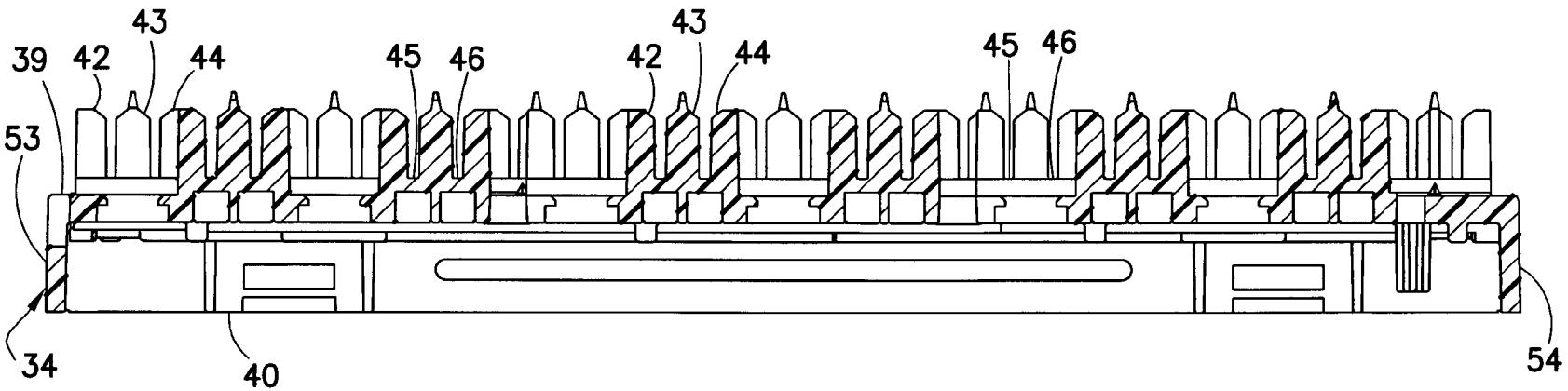
FIG. 9 is a top plan view in cross section of the first housing taken along line 9-9 of FIG. 8.
Figure 10:
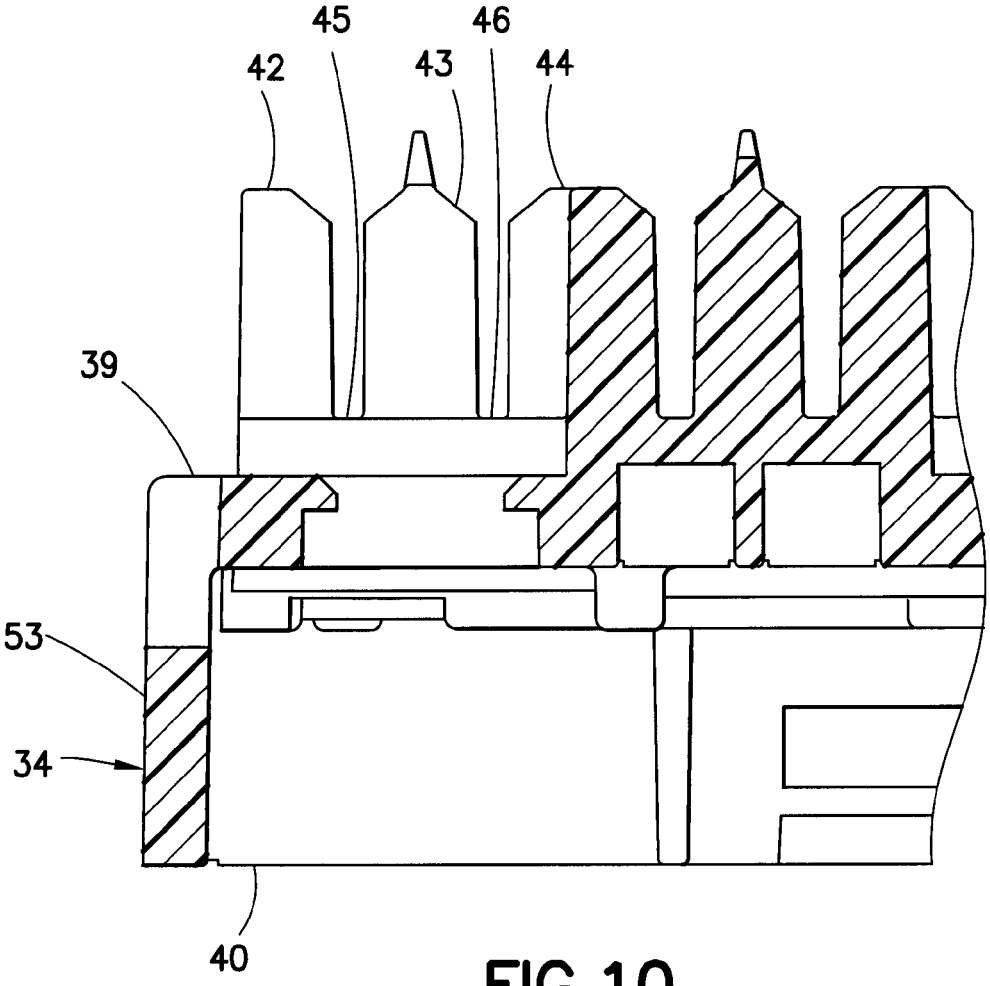
FIG. 10 is an enlarged top plan view of the first housing of FIG. 9 partially in section.

The first housing 34, as shown in FIGS. 6-10, includes an outer surface 39 and an inner surface 40. The first housing 34 is preferably substantially rectangular and has oppositely disposed upper and lower walls 51 and 52 connected by oppositely disposed side walls 53 and 54. Latching slots 55 and 56 are disposed in the upper and lower walls 51 and 52, respectively, to receive latching members of the second housing 35. A plurality of protrusions 41 extend outwardly from the outer surface 39 of the first housing 34, as shown in FIGS. 8-10. As shown in FIG. 8, the protrusions 41 are preferably staggered across the outer surface 39 of the first housing 34 such that first and second rows are formed. The first row of protrusions 41 is closer to the upper wall 51 and the second row is farther from the upper wall 51. As shown in FIG. 8, the protrusions 41 alternate between the first and second rows, i.e., adjacent protrusions are in different rows. A second set of protrusions 41 are similarly arranged proximal the lower wall 52. Each protrusion 41 has first, second and third members 42, 43 and 44. The second member 43 is disposed between the first and third members 42 and 44. Contact slots 45 and 46 are formed between the first and second members 42 and 43 and between the second and third members 43 and 44, respectively. A plurality of fastener holes 47, 48 and 49 pass through the first housing 34 from the outer surface 39 to the inner surface 40.

A plurality of first latching slots 59 extend from the outer surface 39 to the inner surface 40 of the first housing 34, as shown in FIGS. 6 and 8. The first latching slots 59 are preferably disposed between one of the side walls of the first housing 34 and the first protrusion 41, as shown in FIG. 8. A plurality of second latching slots 50 extend from the outer surface 39 to the inner surface 40 of the first housing 34, as shown in FIGS. 6 and 8, to receive second latching members 94 of the stuffer cap 86. Preferably, the second latching slots 50 are disposed adjacent alternating protrusions 41, as shown in FIGS. 7 and 8, and extend substantially parallel to the upper and lower walls 51 and 52. The first latching slots 59 are preferably oriented substantially perpendicular to the second latching slots 50, as shown in FIG. 8. A first latching pocket 57 is disposed in the first side wall 53 and a second latching pocket 58 is formed in the second side wall 54.

The first housing 34 is preferably unitarily formed as a single member. Preferably, the first housing 34 is made of a thermoplastic, such as, but not limited, to a PC/ABS (polycarbonate/Acrylonitrile-Butadiene-Styrene) blend thermoplastic.

The PCB assembly 36 has a first surface 60 from which a plurality of conventional insulation displacement contacts 61 extend outwardly, as shown in FIG. 6. Preferably, the contacts 61 are arranged in pairs across the first surface 60 of the PCB assembly 36. Twenty-four pairs of contacts 61 are preferably connected to the PCB assembly 36 to form an upper section and lower section of contacts 61. The pairs of contacts 61 are staggered across the first surface 60 of the upper and lower sections of the PCB assembly 36 such that a first row of contacts 61 are closer to an upper edge 62 of the PCB assembly and a second row of contacts are closer to a lower edge 63 of the PCB assembly. A pair of upper recesses 64 are formed in the upper edge 62 and a pair of lower recesses 65 are formed in the lower edge 63. A plurality of contact receiving members 7 extend outwardly from a front surface 87 of the PCB assembly. The contacts 61 are electrically connected to the contact receiving members 7.

Figure 16:
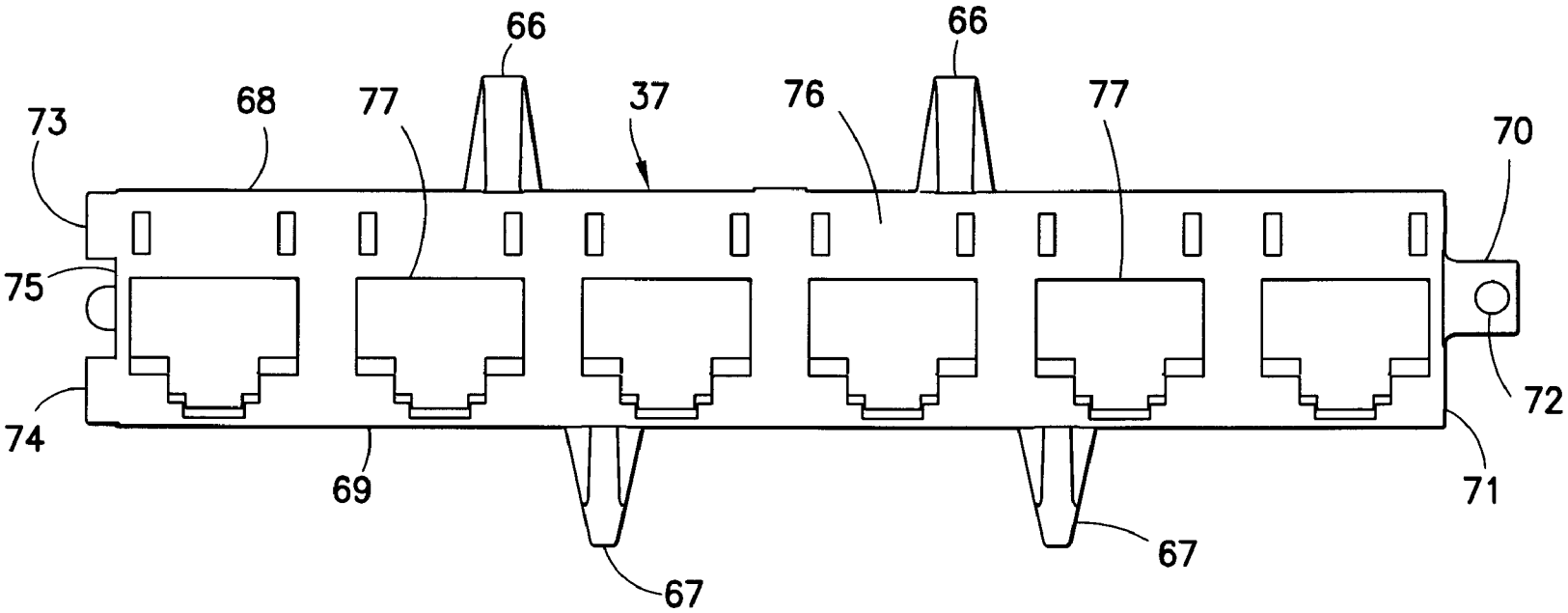
FIG. 16 is a front elevational view of an inner part of a second housing of FIG. 6.

The second housing 35 preferably includes a separately formed inner part 37 and outer part 38, as shown in FIG. 6. The inner part 37 includes a plurality of rearwardly extending upper tabs 66 and a plurality of rearwardly extending lower tabs 67. Preferably, the two upper tabs 66 extend rearwardly from an upper wall 68 and the two lower tabs extend rearwardly from a lower wall 69 of the inner part 37. A fastener hole tab 70 extends outwardly from a first side wall 71 of the inner part 37, as shown in FIG. 16. A fastener hole 72 is formed in the fastener hole tab 70. Upper and lower latching tabs 73 extend outwardly from a second side wall 75 of the inner part 37. A plurality of openings 77 are formed in a front surface 76 of the inner part 37. Preferably, six openings 77 are formed in the front surface 76 of the inner part 37.

The outer part 38 has an aperture 78 defined by an inner wall 79 to receive the inner part 37 of the second housing 35, as shown in FIG. 6. Upper slots 80 and lower slots 81 are formed in the inner wall to receive the upper and lower tabs 66 and 67 of the inner part 37. Upper latching members 82 are formed in an upper surface 84 and lower latching members 83 are formed in a lower surface 85 of the outer part 38.

The inner part 37 of the second housing 35 is preferably made of a polycarbonate thermoplastic with stainless steel filler to provide electrical shielding properties, such as, but not limited to, Faradex. The outer part 38 of the second housing 35 is preferably made of a polycarbonate thermoplastic. The inner and outer parts 37 and 38 are preferably separately formed, as shown in FIG. 6, in view of the shielding properties associated with the inner part 37. Alternatively, the inner and outer parts can be unitarily formed to provide a one-piece second housing.

Figure 3:
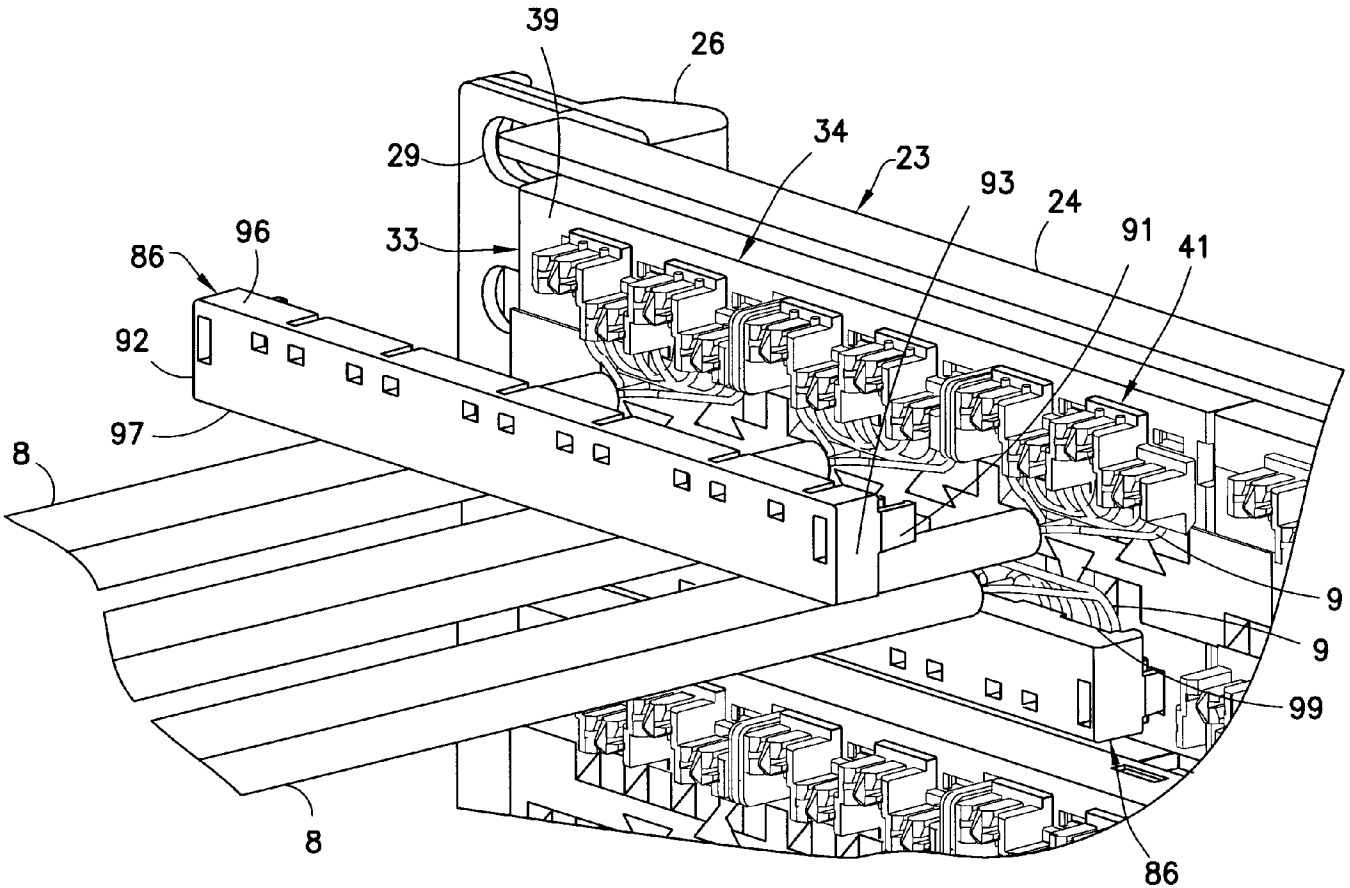
FIG. 3 is an enlarged rear perspective view of the rack system of FIG. 2 and showing a stuffer cap prior to connection to a patch panel adapter assembly.
Figure 11:
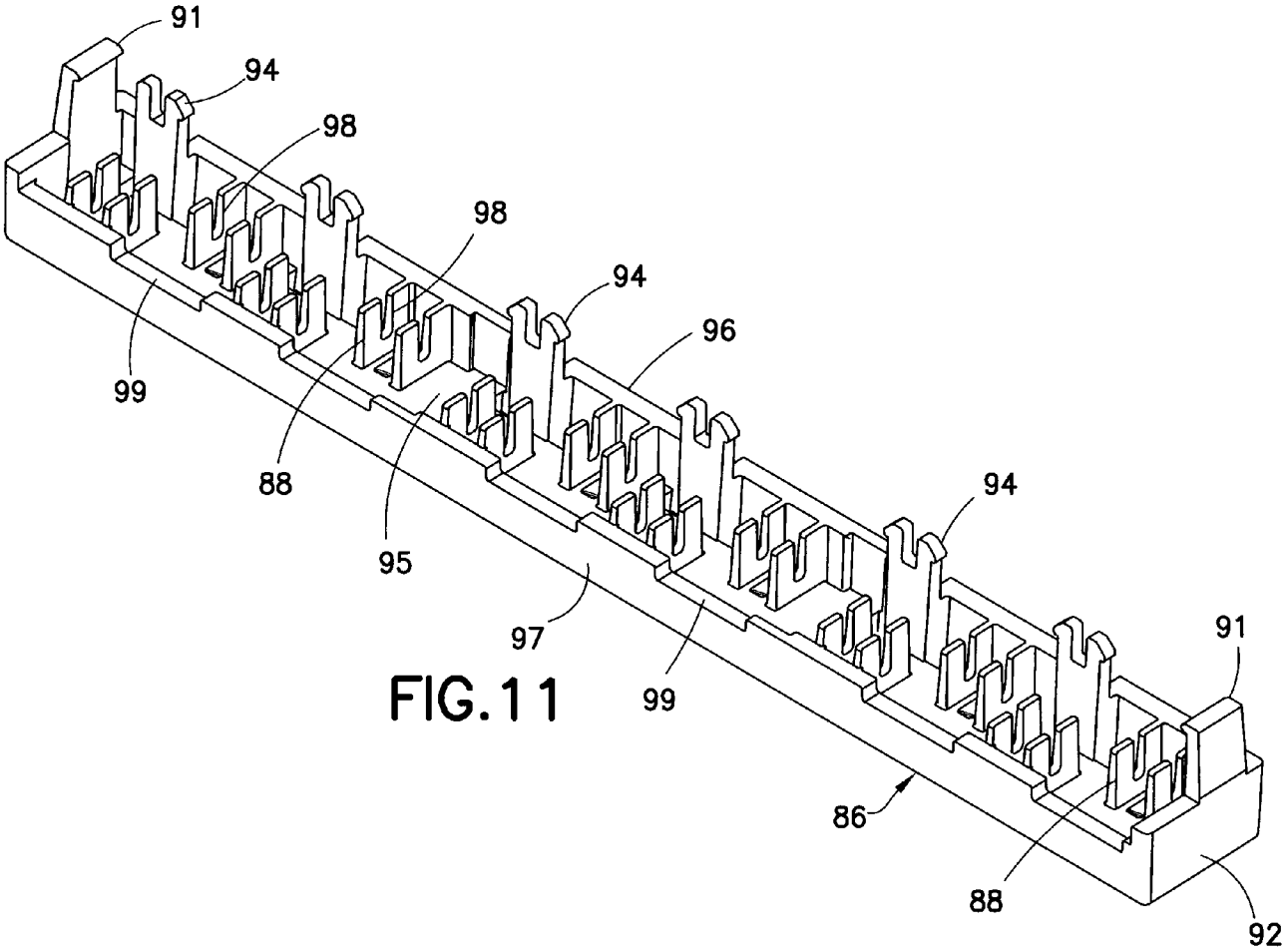
FIG. 11 is a rear perspective view of a stuffer cap in accordance with an exemplary embodiment of the present invention.
Figure 12:
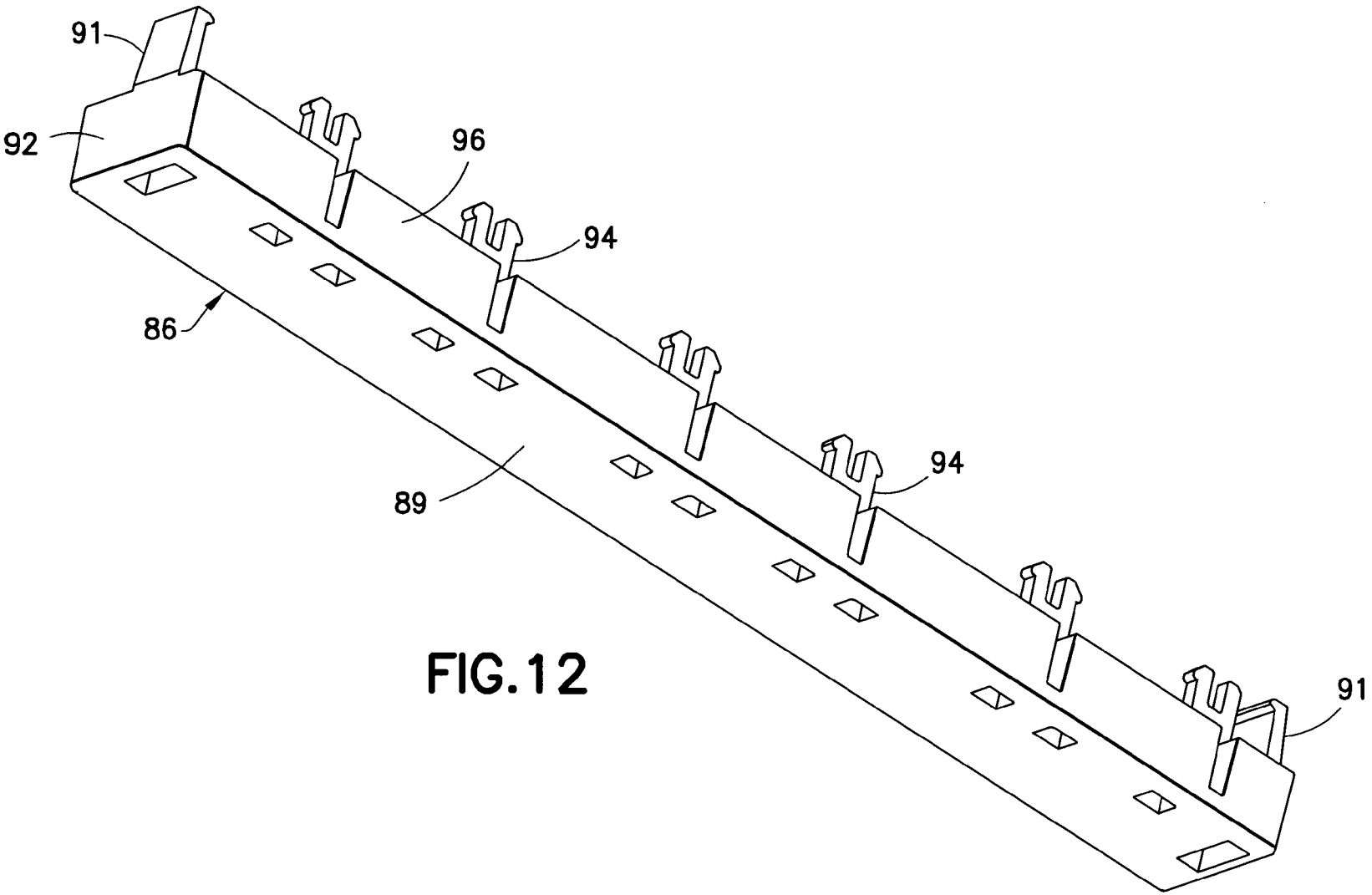
FIG. 12 is a front perspective view of the stuffer cap of FIG. 11.
Figure 13:
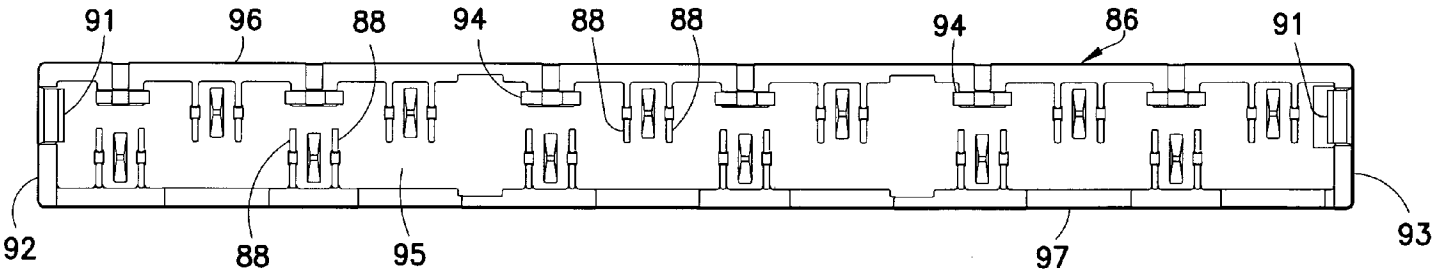
FIG. 13 is a rear elevational view of the stuffer cap of FIG. 11.
Figure 14:
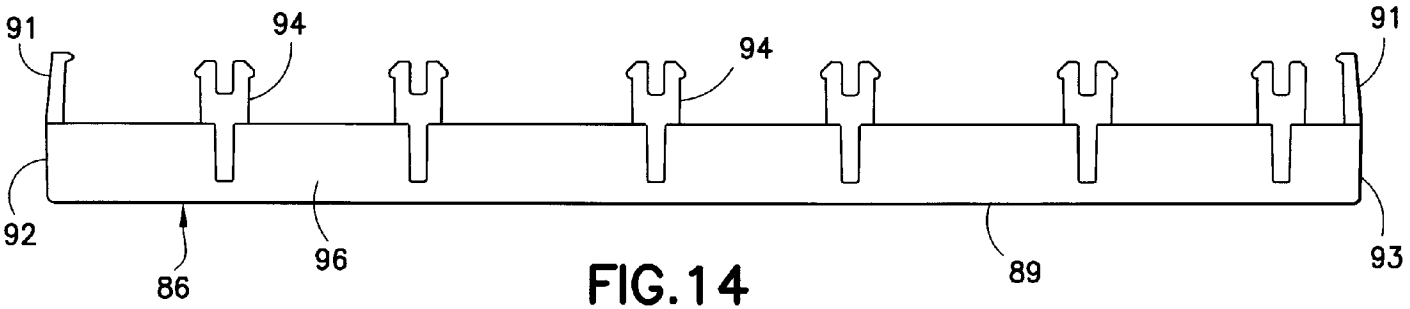
FIG. 14 is a top plan view of the stuffer cap of FIG. 11.
Figure 15:
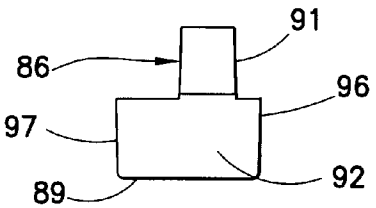
FIG. 15 is a side elevational view of the stuffer cap of FIG. 11.

The stuffer cap 86 includes a body member 87, as shown in FIGS. 6 and 11-15, from which a plurality of strain relief members 88 extend outwardly. The body member 87 includes a base member 89 and a wall 90 extending outwardly therefrom. As shown in FIG. 13, the base member 89 is substantially rectangular. A plurality of first latching members 91 extend outwardly from opposite side walls 92 and 93. A plurality of second latching members 94 extend outwardly from an inner surface 95 of the base member 89. The first latching members 91 are preferably substantially parallel to the side walls 92 and 93 and substantially perpendicular to upper and lower walls 96 and 97. The second latching members 94 are preferably substantially parallel to the upper and lower walls 96 and 97 and substantially perpendicular to the side walls 92 and 93. Preferably, the first latching members 91 are oriented substantially perpendicularly to the second latching members 94, as shown in FIGS. 11 and 13. The plurality of second latching members 94 are preferably disposed between the oppositely disposed first latching members 91, as shown in FIG. 11. A plurality of recesses 99 are formed in the lower wall 97 of the stuffer cap 86 to allow terminated wires 9 to pass therethrough when the stuffer cap is connected to the first housing 34, as shown in FIGS. 3 and 4.

The strain relief members 88 are preferably substantially U-shaped, as shown in FIG. 11. The strain relief members 88 are preferably substantially parallel to the first latching members 91 and substantially perpendicular to the second latching members 94. A gap 98 is formed in each strain relief member 88 to accommodate the insulation displacement contact 61 when the stuffer cap 86 is connected to the first housing 34.

The stuffer cap 86 is preferably unitarily formed as a single piece. The stuffer cap is preferably made of a polycarbonate thermoplastic.

Assembly and Operation

The assembled rack system 11 is shown in FIGS. 1 and 2. The plurality of patch panels 23 are connected between the first and second channel members 12 and 13. Fasteners inserted through the fastener openings 27 and 28 in the first and second ends 25 and 26 of the patch panel 23 are received by openings 21 and 22 in the first and second channel members 12 and 13 to secure the patch panel 23 to the rack system 11. Patch panel adapter assemblies 33 are shown connected to the patch panels 23 in FIGS. 1-4. Cables 8 house a plurality of wires 9, which are terminated by the patch panel adapter assemblies 33. Stuffer caps 86 are connected to the patch panel adapter assemblies 33, as shown in FIGS. 3 and 4, to provide strain relief to and maintain positioning of the terminated wires 9.

Figure 17:
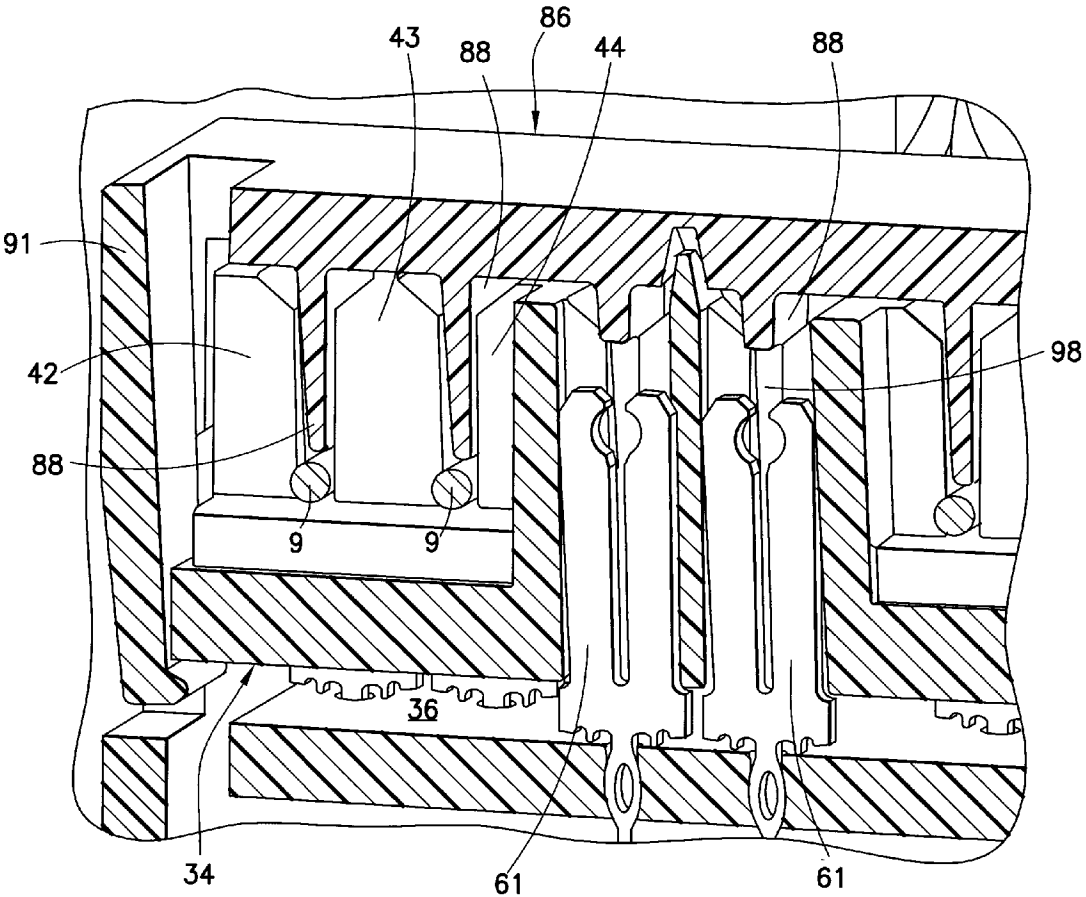
FIG. 17 is a perspective view in cross section of the stuffer cap connected to the first housing.

The patch panel adapter assembly 33, as shown in FIG. 6, is assembled by inserting the insulation displacement contacts 61 of the PCB assembly 36 into the contact slots 45 and 46 in the inner surface 40. The free ends of the insulation displacement contacts 61 are positioned between the first and second members 42 and 43 and between the second and third members 43 and 44, as shown in FIG. 17. The upper and lower tabs 66 and 67 of the inner part 37 of the second housing 35 are inserted through the upper and lower recesses 64 and 65 in the PCB assembly 36. The outer part 38 of the second housing 35 is connected to the first housing 34 such that the inner part 37 is received within the aperture 78 of the outer part. The upper and lower tabs 66 and 67 are received by upper and lower slots 80 and 81 to properly position the inner part 37 within the outer part 38. The upper and lower latching members 83 and 84 are received by the latching slots 55 and 56 of the first housing 34 to securely connect the outer part 38 of the second housing 35 to the first housing 34 with the PCB assembly 36 and inner part 37 of the second housing 35 securely retained therebetween. Fasteners are received by the fastener holes 47, 48 and 49 in the first housing and corresponding fastener holes in the PCB assembly 36 and the inner part 37 of the second housing 35 to further secure the patch panel assembly 33 together.

The assembled patch panel adapter assembly 33 is connected to the patch panel 23, as shown in FIG. 5. The inner part 37 of the second housing 35 is passed through the opening 31 in the patch panel member 24 from a rear side thereof. The upper and lower latching tabs 73 and 74 of the inner part 37 engage an outer surface 7 of the patch panel member 24 and the fastener hole 72 is aligned with the fastener opening 32 of the patch panel 23. A fastener is received by the fastener opening 32 and the fastener hole 72 to secure the patch panel adapter assembly 33 to the patch panel 23, as shown in FIGS. 1-4. As shown in FIG. 5, the openings 77 in the inner part 37 of the second housing 35 are accessible from a front side of the patch panel 23.

Wires 9 of the cables 8 are terminated to the patch panel adapter assembly 33 using a conventional impact tool to force the wires into insulation displacement contacts 61, as is known in the art. The terminated wires 9 are positioned between the first and second members 42 and 43 and between the second and third members 43 and 44 of the first housing, as shown in FIG. 17.

The stuffer cap 86 is then connected to the patch panel adapter assembly 23, as shown in FIGS. 3, 4 and 17. The first latching members 91 of the stuffer cap 86 are received by the first housing 34 such that one of the first latching members 94 is received by the latching pocket 57 and the other first latching member 91 is received by the first latching slot 59. The plurality of second latching members 94 are received by the second latching slots 50 in the first housing 34. Hooks on the ends of the first and second latching members 91 and 94 engage the first housing 34 to prevent accidental removal of the stuffer cap 86 from the patch panel adapter assembly 33. The second latching members 94 engage the second latching slots 50 in the first housing 34 proximal the protrusions 41, thereby facilitating the strain relief provided by the strain relief members 88 that engage the terminated wires 9 in the protrusions 41. Accordingly, the stuffer cap 86 is substantially prevented from accidental removal from the first housing 34, particularly when pulling forces or other strain is applied to the terminated wires 9 or cables 8.

The strain relief members 88 are received between the first and second members 42 and 43 and between the second and third members 43 and 44 of the first housing 34, as shown in FIG. 17. The strain relief members 88 and oriented substantially perpendicularly to the insulation displacement contacts 61 such that the insulation displacement contacts 61 are received within the gaps 98 in the strain relief members. The free ends of the strain relief members 88 engage the terminated wires 9 to provide strain relief to and maintain positioning of the terminated wires 9.

Electrical continuity is established between an electrical connector inserted in the opening 77 in the inner part 37 of the second housing 37 and the electrical wires 9 through the contact receiving members 86 and insulation contact members 61 of the PCB assembly 36.

A tool can be used to remove the first latching members 91 from the corresponding pockets 57 and slots 59 of the first housing 34 to remove the stuffer cap 86 from the patch panel adapter assembly 33. The removed stuffer cap 86 can then be reused.

While an advantageous embodiment has been chosen to illustrate the invention, it will be understood by those skilled in the art that various changes and modifications may be made therein without departing from the scope of the invention as defined in the appended claims.

What is claimed is:

1. A stuffer cap, comprising:

a body member;

a plurality of strain relief members extending outwardly from said body member to engage wires terminated at a patch panel of a rack system;

a plurality of first latching members extending outwardly from said body member to engage the patch panel; and a plurality of second latching members extending outwardly from said body member to engage the patch panel, said plurality of second latching members being oriented differently from said plurality of first latching members.

2. The stuffer cap of claim 1, wherein said plurality of second latching members are substantially perpendicular to said plurality of first latching members.

3. The stuffer cap of claim 1, wherein said plurality of first latching members comprises two first latching members being disposed at opposite ends of said body member.

4. The stuffer cap of claim 3, wherein said plurality of second latching members are disposed between said oppositely disposed first latching members.

5. The stuffer cap of claim 1, wherein each of said plurality of strain relief members is substantially U-shaped.

6. The stuffer cap of claim 1, wherein said body member includes a base member and a wall extending outwardly therefrom.

7. The stuffer cap of claim 6, wherein a plurality of recesses are formed in a free end of said wall to allow the wires engaged by said plurality of strain relief members to pass out of said stuffer cap.

8. The stuffer cap of claim 1, wherein said plurality of strain relief members are substantially perpendicular to said plurality of second latching members.

9. The stuffer cap of claim 1, wherein said plurality of strain relief members are substantially parallel to said plurality of first latching members.

10. A patch panel adapter assembly for terminating wires at a rack system, comprising:

a first housing having a plurality of insulation displacement contacts to terminate wires;

a second housing having a plurality of openings to receive electrical connectors;

a printed circuit board assembly secured between said first and second housings; and a stuffer cap removably connected to said first housing, said stuffer cap including a body member;

a plurality of strain relief members extending outwardly from said body member to engage wires terminated by said plurality of insulation displacement contacts;

a plurality of first latching members extending outwardly from said body member to engage said first housing; and a plurality of second latching members extending outwardly from said body member to engage said first housing, said plurality of second latching members being oriented differently from said plurality of first latching members.

11. The patch panel adapter assembly of claim 10, wherein said first housing, said printed circuit board assembly and said second housing are secured together by at least one fastener passing therethrough.

12. The patch panel adapter assembly of claim 10, wherein a plurality of slots in said first housing removably receive said plurality of second latching members.

13. The patch panel adapter assembly of claim 10, wherein a plurality of pockets in said first housing removably receive said plurality of first latching members.

14. The patch panel adapter assembly of claim 10, wherein said plurality of second latching members are substantially perpendicular to said plurality of first latching members.

15. The patch panel adapter assembly of claim 10, wherein said body member includes a base member and a wall extending outwardly therefrom.

16. The patch panel adapter assembly of claim 15, wherein a plurality of recesses are formed in a free end of said wall to allow the wires engaged by said plurality of strain relief members to pass out of said stuffer cap.

17. The patch panel adapter assembly of claim 10, wherein said plurality of strain relief members are substantially perpendicular to said plurality of second latching members.

18. The patch panel adapter assembly of claim 10, wherein said plurality of strain relief members are substantially parallel to said plurality of first latching members.

19. The patch panel adapter assembly of claim 10, wherein said second housing is securable to the patch panel of the rack system.

20. The patch panel adapter assembly of claim 10, wherein a plurality of third latching members connected to said second housing are releasably connected to said first housing.

* * * * *